US005566415A

United States Patent [19]

Wallace

[11] Patent Number: 5,566,415

[45] Date of Patent: Oct. 22, 1996

[54] HOSE CLEANING APPARATUS

[76] Inventor: Thomas M. Wallace, 0274 Beard Creek Rd., Edwards, Colo. 81632

[21] Appl. No.: 579,338

[22] Filed: Dec. 27, 1995

[51] Int. Cl.[6] ..... B08B 9/02

[52] U.S. Cl. ..... 15/88.1; 15/104.04; 15/104.92

[58] Field of Search ..... 15/88, 88.1, 104.04, 15/104.03, 104.92, 40; 134/122 R

[56] References Cited

U.S. PATENT DOCUMENTS

| | | | |
|---|---|---|---|
| 1,676,825 | 7/1928 | Haase | 15/88 |
| 3,189,935 | 6/1965 | Euga | 15/104.04 |
| 3,758,913 | 9/1973 | Elliott et al. | 15/88 |
| 3,903,561 | 9/1975 | McCaslin | 15/88 |
| 4,391,016 | 7/1983 | Kawamura et al. | 15/88 |
| 4,502,175 | 3/1985 | Hillis | 15/104.92 |
| 4,503,577 | 3/1985 | Fowler | 15/88 |
| 4,734,950 | 4/1988 | Schenke et al. | 15/88 |
| 5,077,861 | 1/1992 | Bokat | 15/88.1 |
| 5,316,588 | 5/1994 | Dyla | 15/104.04 |

FOREIGN PATENT DOCUMENTS

| | | | |
|---|---|---|---|
| 604183 | 4/1960 | Italy . | |
| 81501 | 9/1934 | Sweden | 15/88 |

*Primary Examiner*—David Scherbel
*Assistant Examiner*—Tony G. Soohoo
*Attorney, Agent, or Firm*—Richard C. Litman

[57] ABSTRACT

A cleaning apparatus for cleaning of cleaning hoses comprises a hose-surrounding base and wall combination through which cleaning hoses are fed while being wound onto a hose storage spool mounted in a cleaning vehicle. The hose-surrounding base and wall combination has a hose container with a plurality of jets that forcefully spray water at the hoses as they pass through the base. The jets are supplied with pressurized water by a source hose connected to a source tank mounted in the cleaning vehicle. There is a weighted waste pan in the base having a declining bottom portion. Dirty water is withdrawn from the waste pan by a withdrawing hose connected to a waste tank also mounted in the cleaning vehicle. The base is openable to allow insertion and withdrawal of cleaning hoses. Overspray guards attached to the base prevent unwanted seepage of waste water from the base.

14 Claims, 2 Drawing Sheets

HOSE CLEANING APPARATUS

BACKGROUND OF THE INVENTION

1. Field of the Inventtion

The present invention relates generally to cleaning apparatus, and more specifically to hose cleaning apparatus.

2. Description of the Prior Art

As fewer and fewer people have the time and inclination to clean their own carpets, it is becoming increasingly common for carpet owners to hire professional carpet cleaners to clean their carpets. While some small, unusual carpets can be removed for cleaning, the typical wall-to-wall style carpet is left installed during the cleaning process. As it happens, cleaning of installed carpeting with manually portable cleaning apparatus is too time-consuming to be practical, and therefore, a cleaning vehicle (such as a van) with long, deployable cleaning hoses is commonly used. Unfortunately, such hoses tend to be unwieldy and, when dirty, can cause more harm than good, inasmuch as dirt accidentally placed on the hose is spread onto every piece of furniture and carpeting that the hose touches as a worker drags the hose to the carpet meant to be cleaned. Thus, it is important to clean the cleaning hoses, themselves, in order to avoid "dirtying" a carpet or furniture when actually intending to clean carpet. Dirty hoses on carpets are an especially pernicious problem because dragging the hoses over carpets generates static electricity, which tends to bind dirt strongly to the carpet.

A problem encountered with cleaning standard cleaning hoses, however,is that cleaning hoses generally have a ridged configuration. This ridged configuration has the advantage of providing extensibility to a cleaning hose, but this configuration simultaneously has the disadvantage of making cleaning of the cleaning hose rather difficult. Prior cleaning apparatus have failed to meet the clear need for an apparatus that cleans cleaning hoses, in the way the present invention does.

U.S. Pat. No. 3,189,935, issued to Arthur B. Euga, on Jun. 22, 1965, shows a device for cleaning tubular articles, including imperfect cylinders. The device has a plurality of sponge fingers that rub against the tubular articles. There is no provision of jets that propel water to all surfaces of a tubular article.

U.S. Pat. No. 4,502,175, issued to William J. Hillis, on Mar. 5, 1985, shows an apparatus for cleaning fire hoses via a plurality of opposed bristle brushes. Water jets spray water at a hose as it passes through the apparatus. There is no hose-surrounding base having attached overspray guards.

U.S. Pat. No. 4,503,577, issued to David E. Fowler, on Mar. 12, 1985, shows a hose decontaminator that provides high-pressure Freon and brushes configured to decontaminate pipes and hoses in the decontaminator. There is no hose-surrounding base having attached overspray guards.

U.S. Pat. No. 4,734,950, issued to Reynold A. Schenke et al., on Apr. 5, 1988, shows an apparatus for cleaning elongated members, such as pipe, by passing the members through a container having helically disposed brushes and gravity-fed cleaning solvent. There is no hose-surrounding base having attached overspray guards.

U.S. Pat. No. 5,077,861, issued to Charles Bokat, on Jan. 7, 1992, shows a hose cleaner that is generally cylindrical and hingedly opens, apparently to aid construction. Water flows in two directions to aid brushes in cleaning of a hose passed through the cleaner. There is no hose-surrounding base having attached overspray guards.

Swedish Patent Document No. 81501, issued to J. 0. N. Oberg, on Sep. 18, 1934, shows a device having brushes, through which a hose can be passed. There is no hose-surrounding base having attached overspray guards.

Italian Patent Document No. 604183, issued to Giorgio Balasso, on Apr. 29, 1960, shows a device in which a plurality of brushes rotatedly engage a cylindrical member. There is no hose-surrounding base having attached overspray guards.

None of the above inventions and patents, taken either singly or in combination, is seen to describe the instant invention as claimed.

SUMMARY OF THE INVENTION

A cleaning apparatus for cleaning of cleaning hoses, according to the present invention, comprises a hose-surrounding base and wall combination through which cleaning hoses are fed while being wound onto a hose storage spool mounted in a cleaning vehicle. The hose-surrounding base and wall combination has a hose container with a plurality of jets that forcefully spray water at the hoses as they pass through the base. The jets are supplied with pressurized water by a source hose connected to a source tank mounted in the cleaning vehicle. Simultaneously, brushes mechanically scrape dirt from the hoses. There is a weight in the base that prevents unwanted movement of the base. The base has a waste pan region configured at a declining angle relative to a surface on which the apparatus might be placed. This waste pan region receives dirty water and, with aid of gravity, directs dirty water towards a receiving outlet. Dirty water is withdrawn from the base by a withdrawing hose connected to the receiving outlet at one end and a waste tank also mounted in the cleaning vehicle, at the other end. The base is openable to allow insertion and withdrawal of cleaning hoses. Overspray guard walls attached to the base prevent unwanted seepage of waste water from the base. A handle on the hose container ensures portability of the apparatus. The hose container is openable to allow ease of use and maintenance.

Accordingly, it is a principal object of the invention to provide an apparatus that conveniently, cleanly, and safely cleans cleaning hoses.

It is another object of the invention to prevent splashing of waste water from an apparatus for cleaning of cleaning hoses.

It is a further object of the invention to ensure portability of an apparatus for cleaning of cleaning hoses.

Still another object of the invention is to avoid necessity for a power supply in a cleaning apparatus for cleaning hoses.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
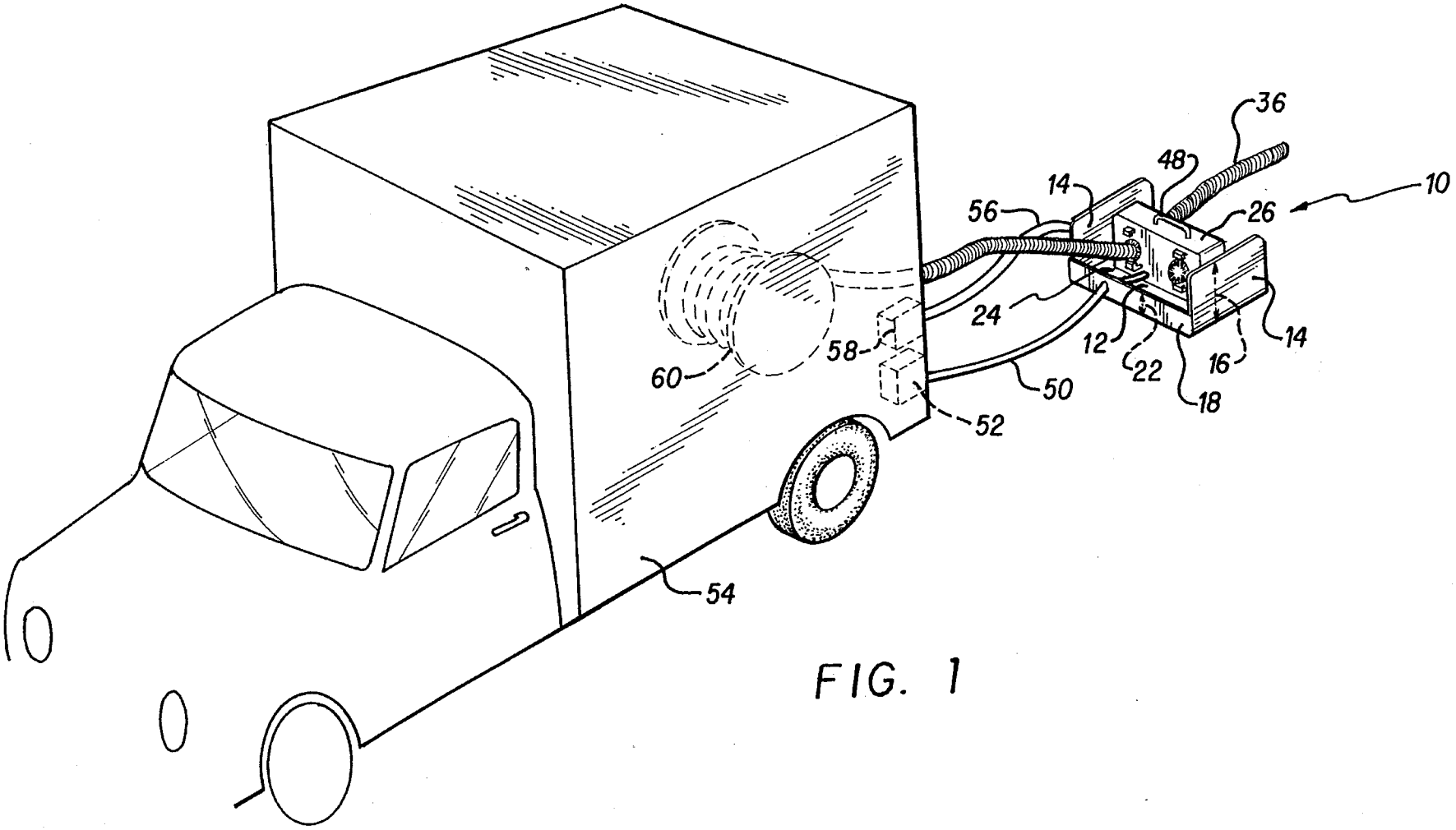
FIG. 1 is an environmental, perspective view of the present invention when cleaning a cleaning hose as the hose is reeled onto a receiving spool.
Figure 2:
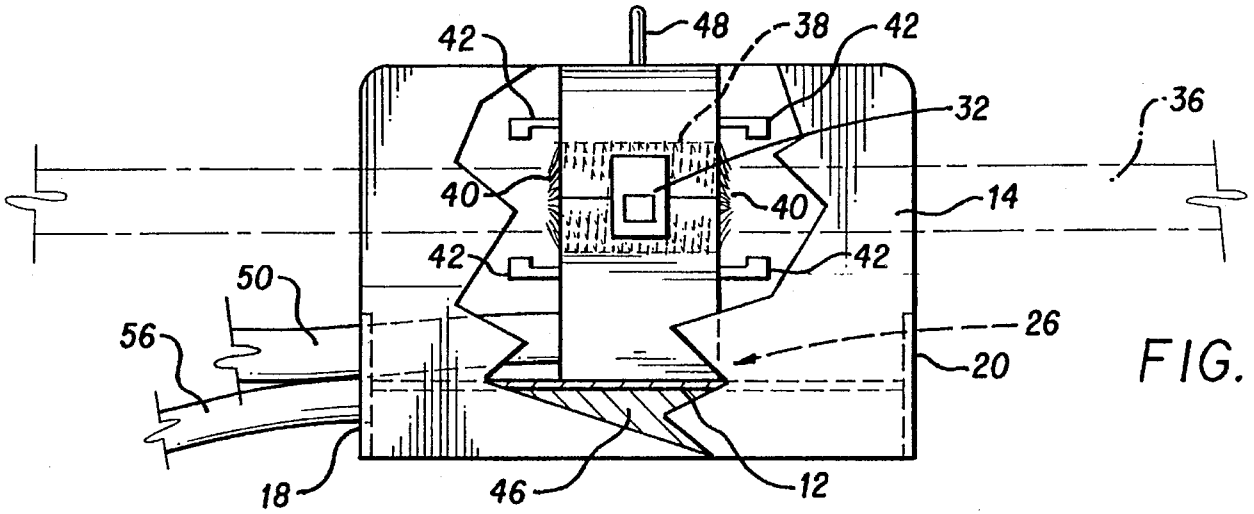
FIG. 2 is a side section view of the present invention.
Figure 3:
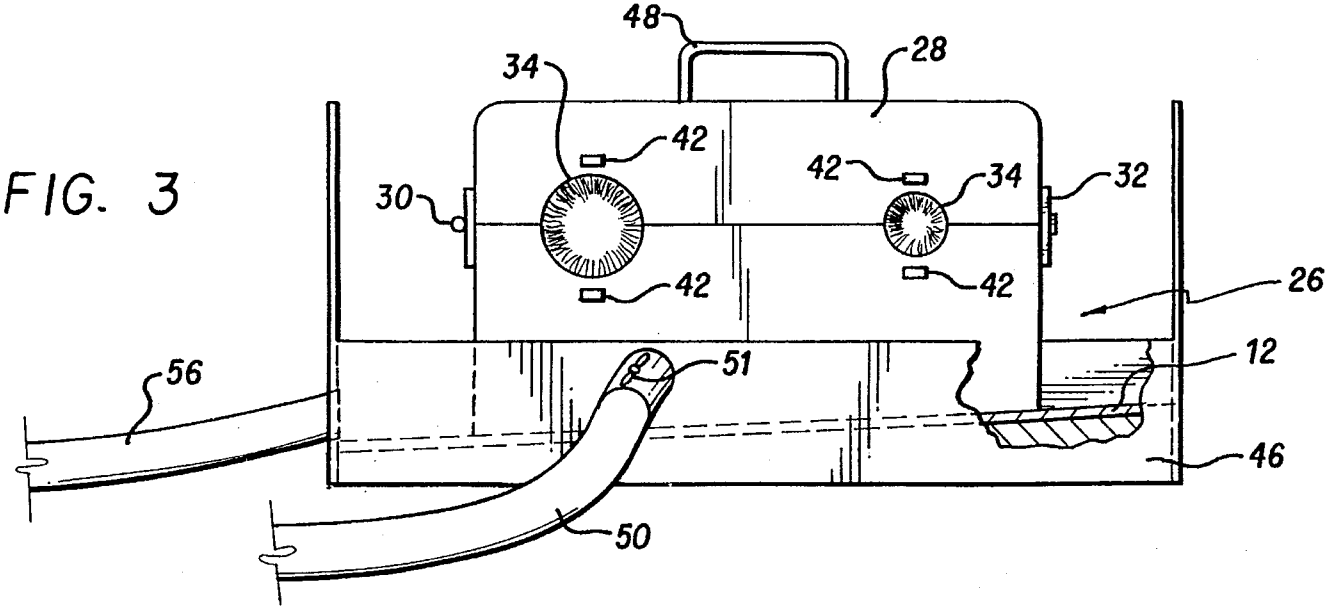
FIG. 3 is a front elevational view of the present invention.

The present invention is an apparatus for cleaning hoses that are used in cleaning carpets. Such hoses typically have ridges that collect dirt that is difficult to extirpate. Dragging dirty hoses across carpet leads to some of the dirt adhering to the carpet, especially when the dragging generates dirt-binding static electricity on the carpet.

Referring to the drawings, a hose cleaning apparatus 10, according to the present invention, comprises a generally rectangular, planar base 12 having a declining angle, two side spray guard walls 14 extending a first predetermined height 16 upwardly from the base 12, a front wall 18 and a back wall 20 extending a second predetermined height 22 upwardly from the base 12, the second predetermined height 22 preferably being about one third of the first predetermined height. 16, although the second predetermined height 22 may be as little as one-fifth or as much as one-half the first predetermined height 16. The base 12, the two side spray guard walls 14, the front wall 18 and the back wall 20 configured to form a fluid-retaining receptacle 24.

There is a hose container 26 affixed centrally on the base 12, the hose container 26 having a selectively openable lid 28. This lid 28 has a hinge 30 of known type dimensioned and configured to allow selective opening of the hose container 26, and a lock 32 of known type dimensioned and configured to allow selectively obstruction of the selective opening of the hose container 26. Preferably, the two side spray guard walls 14 extend above the hose container 26.

There is a plurality of apertures 34 opposingly disposed in the hose container 26, the plurality of apertures 34 being dimensioned and configured to allow passage of at least one hose 36 through the hose container 26, the plurality of apertures 34 being entirely above the front wall 18 and the back wall 20, relative to the base 12.

There is at least one brush-supporting cylinder 38 in the hose container 26, the cylinder 38 being connected between and in communication with the plurality of apertures 34. Brushes 40 are disposed within and around the at least one brush-supporting cylinder 38, whereby a hose 36 passed through the at least one cylinder 38 frictionally engages the brushes 40.

There is a plurality of hollow jets 42 disposed adjacent the plurality of apertures 34, the plurality of hollow jets 42 having spray openings 44 directed toward the plurality of apertures 34. The plurality of hollow jets 42 communicates with the hose container 26, whereby pressurized fluid (not shown) in the hose container 26 is received by the plurality of hollow jets 42 and expelled through the spray openings 44 of the plurality of hollow jets 42.

A flat, generally rectangular weight 46 is affixed to the base 12, the weight weighing between five and fifteen pounds, preferably ten pounds. There is a handle member 48 affixed to the apparatus 10. This handle member 48 enables lifting of the apparatus 10 when the selective opening is selectively obstructed by the lock 32.

There is a generally tubular supply member 50 connected to and communicating with the hose container 26, whereby pressurized fluid is supplied to the hose container 26, the supply member 50 having a valve 51 for selectively preventing communication of the tubular supply member 50 with the hose container 26. The supply member 50 is further connected to and in communication with a source 52 of pressurized fluid, the source 52 of pressurized fluid being mounted in a cleaning vehicle 54. There is also a generally tubular withdrawal member 56 connected to and in communication with the fluid-retaining receptacle 24, whereby waste fluid is withdrawn from the fluid-retaining receptacle 24, the withdrawal member being further connected to and in communication with a source of suction 58, the source of suction 58 being mounted in the cleaning vehicle 54.

Operation of the apparatus 10 involves insertion of a dirty hose 36 into a pair of opposing apertures 34 in the apparatus 10. The hose 36 is then pulled through the apparatus 10, preferably by a rotating spool 60 mounted in a cleaning vehicle 54. When a hose 36 is thus forced through the plurality of opposingly disposed apertures 34, and pressurized fluid is expelled from the plurality of hollow lets 42, the hose 36 is cleaned by the pressurized fluid and by the brushes 40. A worker dries off the cleaned hose 36 as it is pulled from the apparatus 10, by use of a clean, dry rag.

It is to be understood that the present invention is not limited to the sole embodiment described above, but encompasses any and all embodiments within the scope of the following claims.

I claim:

1. A hose cleaning apparatus comprising:

a generally rectangular, planar base;

two side spray guard walls extending a first predetermined height upwardly from said base;

a front wall and a back wall extending a second predetermined height upwardly from said base, said second predetermined height being one fifth to one half of said first predetermined height, said base, said two side spray guard walls, said front wall and said back wall forming a fluid-retaining receptacle; for receiving waste fluid during the cleaning of a hose;

a hose container affixed centrally on said base and containing a pressurized fluid, said hose container having a selectively openable lid;

at least one set of apertures opposingly disposed in said hose container, said at least one set of apertures being dimensioned and configured to allow passage of a hose through said hose container;

a brush-supporting cylinder in said hose container, said brush-supporting cylinder being connected between and in communication with said at least one set of apertures;

brushes disposed within said brush-supporting cylinder, whereby a hose passes through said brush-supporting cylinder cylinder frictionally engages said brushes;

a plurality of hollow jets disposed adjacent to said at least one set of apertures, said plurality of hollow jets having spray openings directed toward said at least one set of apertures, said plurality of hollow jets being fluidly connected to said hose container, whereby said pressurized fluid in said hose container is received by said plurality of hollow jets and expelled through said spray openings of said plurality of hollow jets;

a generally tubular Supply member connected to and fluidly communicating with said hose container, whereby said pressurized fluid is supplied to said hose container; and a generally tubular withdrawal member connected to and in fluid communication with said fluid-retaining receptacle, whereby said waste fluid is withdrawn from said fluid retaining receptacle;

whereby, when a hose is forced through said set of apertures, and pressurized fluid is expelled from said plurality of hollow jets, the hose is cleaned by the pressurized fluid and by the brushes.

2. The hose cleaning apparatus according to claim 1, wherein said second predetermined height is about one third of said first predetermined height.

3. The hose cleaning apparatus according to claim 1, further including a flat, generally rectangular weight affixed to said base.

4. The hose cleaning apparatus according to claim 3, wherein said weight weighs between five and fifteen pounds.

5. The hose cleaning apparatus according to claim 1, wherein said base is disposed in a declining angle such that said waste fluid is directed to said withdrawal number.

6. The hose cleaning apparatus according to claim 1, wherein said lid has a hinge connecting said lid to said hose container.

7. The hose cleaning apparatus according to claim 1, wherein said lid has a lock.

8.The hose cleaning apparatus according to claim 7, further including a handle member affixed to said hose container.

9.The hose cleaning apparatus according to claim 1, further including a handle member affixed to the apparatus, whereby said handle member enables lifting of the apparatus.

10. The hose cleaning apparatus according to claim 1, wherein said let of apertures being disposed in said hose container at a height entirely above said front wall and said back wall.

11. The hose cleaning apparatus according to claim 1, wherein said supply member is further connected to and in fluid communication with a source of pressurized fluid, said source of pressurized fluid being mounted in a cleaning vehicle, and said withdrawal member is further connected to and in fluid communication with a source of suction, said source of suction being mounted in the cleaning vehicle.

12. The hose cleaning apparatus according to claim 1, wherein said two side spray guard walls extend at a height above said hose container.

13. The hose cleaning apparatus according to claim 1, wherein said supply member has a valve for selectively preventing fluid communication of said supply member with said hose container.

14. A hose cleaning apparatus comprising:

a generally rectangular, planar base having a declining angle;

two side spray guard walls extending a first predetermined height upwardly from said base;

a front wall and a back wall extending a second predetermined height upwardly from said base, said second predetermined height being about one third of said first predetermined height, said base and containing a pressurized fluid, said two side spray guard walls, said front wall and said back wall configured to form a fluid-retaining receptacle for receiving waste fluid during the cleaning of a hose;

a hose container affixed centrally on said base, said hose container having a selectively openable lid, said selectively openable lid having a hinge connecting said lid to said hose container, said selectively openable lid further having a look said two side spray guard walls extending at a height above said hose container;

at least one set of apertures opposingly disposed in said hose container, said at least one set of apertures being dimensioned and configured to allow passage of a hose through said hose container, said set of apertures being at a height entirely above the height of said front wall and said back wall;

at least one brush-supporting cylinder in said hose container, said brush-supporting cylinder being connected between and in communication with said at least one set of apertures;

brushes disposed within said brush-supporting cylinder, whereby a hose passes through said brush-supporting cylinder frictionally engages said brushes;

a plurality of hollow jets disposed adjacent to said at least one set of apertures, said plurality of hollow jets having spray openings directed toward said at least one set of apertures, said plurality of hollow jets being fluid connected to said hose container, whereby said pressurized fluid in said hose container is received by said plurality of hollow jets and expelled through said spray openings of said plurality of hollow jets;

a flat, generally rectangular weight affixed to said base, said weight weighing between five and fifteen pounds;

a handle member affixed to the apparatus, whereby said handle member enables lifting of the apparatus;

a generally tubular supply member connected to and fluidly communicating with said hose container, whereby pressurized fluid is supplied to said hose container, said supply member having a valve for selectively preventing fluid communication of said supply member with said hose container, said supply member being further connected to and in fluid communication with a source of pressurized fluid, said source of pressurized fluid being mounted in a cleaning vehicle; and a generally tubular withdrawal member connected to and in fluid communication with said fluid-retaining receptacle, whereby said waste fluid is withdrawn from said fluid retaining receptacle, said withdrawal member being further connected to and in communication with a source of suction, said source of suction being mounted in the cleaning vehicle;

whereby, when a hose is forced through said set of apertures, and pressurized fluid is expelled from said plurality of hollow jets, the hose is cleaned by the pressurized fluid and by the brushes.

* * * * *